US007052161B2

(12) United States Patent
Lichtenstein et al.

(10) Patent No.: US 7,052,161 B2
(45) Date of Patent: May 30, 2006

(54) ILLUMINATIVE DEVICE

(75) Inventors: Hans Lichtenstein, Reinheim (DE); Jann Schmidt, Darmstadt (DE); Guenther Ittmann, Gross-Umstadt (DE); Eduard Albrecht, Frankfurt (DE)

(73) Assignee: ROEHM GmbH & Co. KG, Darmstadt (DE)

( * ) Notice: Subject to any disclaimer, the term of this patent is extended or adjusted under 35 U.S.C. 154(b) by 35 days.

(21) Appl. No.: 10/492,362

(22) PCT Filed: Nov. 21, 2002

(86) PCT No.: PCT/EP02/13057

§ 371 (c)(1),
(2), (4) Date: Apr. 13, 2004

(87) PCT Pub. No.: WO03/052315

PCT Pub. Date: Jun. 26, 2003

(65) Prior Publication Data

US 2005/0002189 A1 Jan. 6, 2005

(30) Foreign Application Priority Data

Dec. 18, 2001 (DE) ..... 101 62 360

(51) Int. Cl.
*F21V 3/04* (2006.01)

(52) U.S. Cl. ..... 362/311; 362/351

(58) Field of Classification Search ..... 362/311, 362/351

See application file for complete search history.

(56) References Cited

U.S. PATENT DOCUMENTS

| | | | | |
|---|---|---|---|---|
| 4,773,913 | A | 9/1988 | Krieg et al. | |
| 4,957,987 | A | 9/1990 | Krieg et al. | |
| 5,355,284 | A | 10/1994 | Roberts | |
| 5,449,727 | A | 9/1995 | Krieg et al. | |
| 5,684,633 | A | 11/1997 | Lutz et al. | |
| 5,837,160 | A | 11/1998 | Dietz et al. | |
| 6,113,801 | A | 9/2000 | Savant et al. | |
| 2003/0079387 | A1 * | 5/2003 | Derose | 40/544 |
| 2004/0264159 | A1 | 12/2004 | Schmidt et al. | |

FOREIGN PATENT DOCUMENTS

| | | |
|---|---|---|
| EP | 0504926 | 9/1992 |
| EP | 0615141 | 9/1994 |
| EP | 1029650 | 8/2000 |
| EP | 1043365 | 10/2000 |
| FR | 2800739 | 5/2001 |

* cited by examiner

*Primary Examiner*—Renee Luebke
*Assistant Examiner*—Leah Lovell
(74) *Attorney, Agent, or Firm*—Oblon, Spivak, McClelland, Maier & Neustadt, P.C.

(57) ABSTRACT

The invention relates to an illuminative device essentionaly comprising a light source and a diffusing cover which is assigned to the light source and is made of colored plastic. The light source consites of one or several light-emitting diodes (LEDs) emitting a colored an substantially monocromatic light. The diffusing cover assigned thereto has a transmition (DIN 5036) of at least 35% and a reflection (DIN 5036) of at least 15% with the wavelength of the light-emitting diode operating at relative maximum energy.

18 Claims, 3 Drawing Sheets

ILLUMINATIVE DEVICE

ILLUMINATIVE DEVICE

Figure 1:
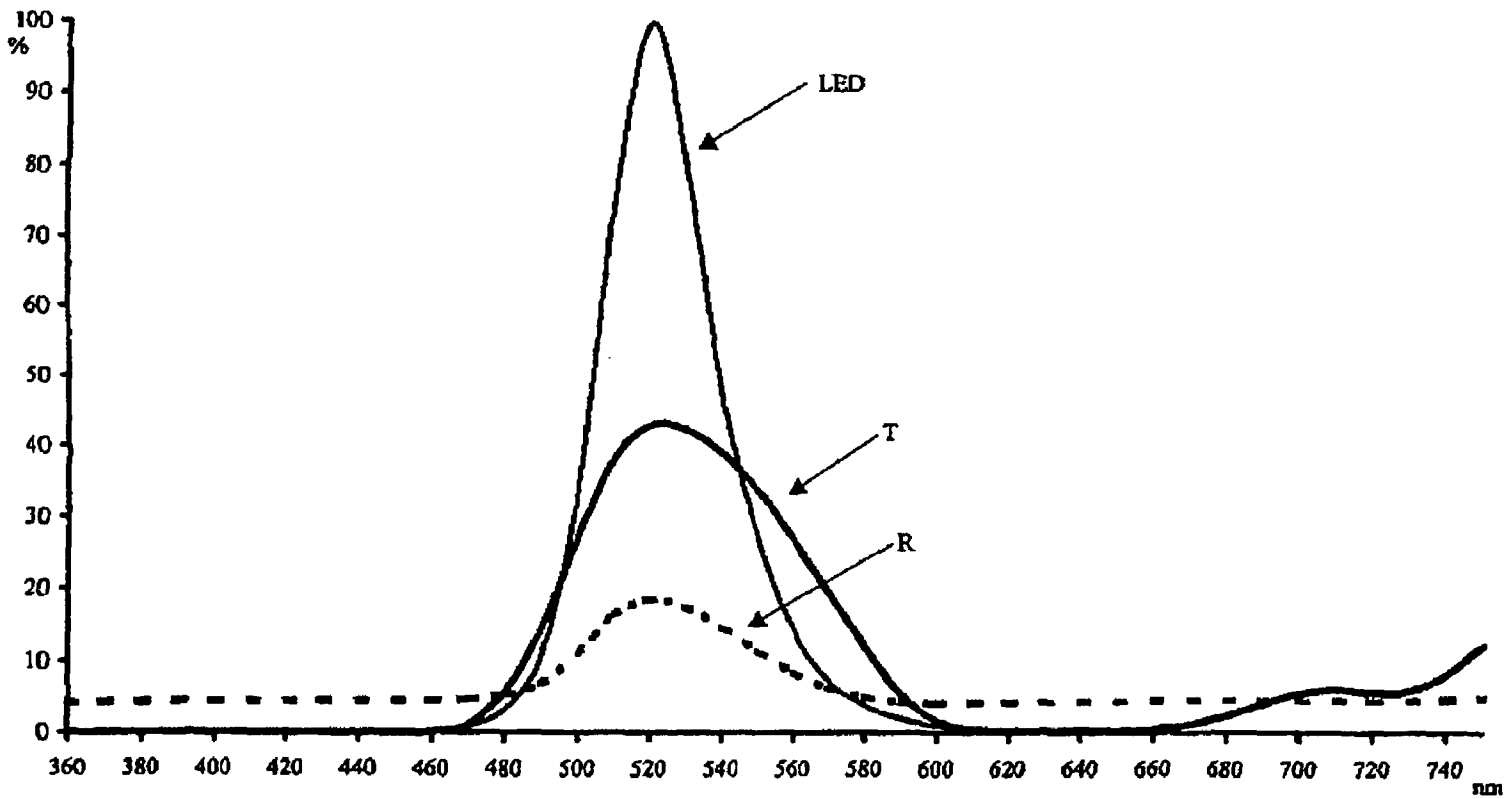

The invention relates to an illuminatable device, consisting essentially of a light source and a light-scattering cover which is associated with the light source and is made of coloured plastic.

PRIOR ART

Illuminatable devices, for example for advertising displays, consisting essentially of a light source and a light-scattering cover which is associated with the light source and is made of coloured plastic, are known in principle A2 (see, for example, JP 61159440). Incandescent lamps or fluorescent tubes, which have a good luminosity and emit a broad light spectrum, are generally used as the light sources. Owing to the broad light spectrum, correspondingly coloured plastic covers in the unilluminated state, that is to say for example in daylight, appear with the same colour impression as can be perceived when backlit by means of the said light sources.

Compared with light sources such as incandescent lamps or fluorescent tubes, light-emitting diodes have a significantly lower luminosity. Colour light-emitting diodes, however, can be nevertheless be perceived very well in darkness since they emit almost monochromatic light, which is in turn relatively intense in the respective wavelength range. Corresponding colour light-emitting diodes are available from many manufacturers, for example in the colours red, green, blue and yellow.

Colorations and colouring methods for plastics, for example polymethyl methacrylate, are sufficiently well known, for example from EP-A 130 576.

OBJECT AND SOLUTION

It was therefore considered an object to provide an alternative to the known illuminatable device in which coloured covers made of plastic can be through-lit by means of incandescent lamps or fluorescent tubes. In particular, the device is intended to permit optically about the same colour impression under incident light, that is to say for example in daylight, as under transmitted lighting. The device is intended to permit smaller structural depths than the previously known devices, and to be distinguished by a lower electrical consumption.

The object is achieved by an illuminatable device, consisting essentially of a light source and a light-scattering cover which is associated with the light source and is made of coloured plastic, characterised in that the light source consists of one or more light-emitting diodes (LEDs) which emit coloured, essentially monochromatic light, and the associated light-scattering cover has a transmission (DIN 5036) of at least 35% and a reflection (DIN 5036) of at least 15% at the wavelength of the relative energy maximum of the light-emitting diode.

The invention is based on the transmission and the re-emission of the light-scattering cover made of plastic being matched to the monochromatic light of the LED which is used, in such a way that almost the same colour impression can be obtained under incident light as well as with transmitted light. Advertising or information displays therefore appear optically about the same both by day and in the backlit state.

This matching permits the use of colour LEDs, or LEDs emitting monochromatic light, for the said purpose. The structural depths required by the illuminatable device according to the invention are less, since LEDs are smaller than corresponding incandescent lamps or fluorescent tubes. Complicated shaping can also be carried out more easily. The electrical consumption is lower for almost the same perceptibility in the backlit state. Since LEDs can be operated with low voltages, the electrical safety of the devices according to the invention is to be regarded as higher, or easier to guarantee. The maintenance outlay is likewise less, since LEDs generally need to be replaced less often.

The invention will be explained by the following figures, but without being restricted to the embodiments which are presented.

FIG. 1

Transmission/re-emission spectrum of a coloured light-scattering plastic disc (green 1, example series 1) with suitability as a cover for a device according to the invention which can be illuminated with a green-lighting LED.

T= transmission spectrum

R= re-emission spectrum

LED= relative energy curve of the green LED with relative energy maximum at about 520 nm

FIG. 2

Representation of the standard colour chart with an example of the matching or determination of suitable colour loci of the transmission and re-emission of plastic covers with suitability for a particular colour LED. The suitable colour loci lie in the part of a resulting rectangle which lies inside the standard colour chart.

LED= colour locus of the LED

U= achromatic point (x/y=0.33/0.33)

A= maximum colour-locus distance (0.2 units) from the colour locus of the LED to the straight line through U and LED B= maximum colour-locus distance (0.05 units) on both sides at a right angle to the straight line through U and LED.

T= colour locus of the transmission of the cover

R= colour locus of the reflection of the cover.

Figure 3:
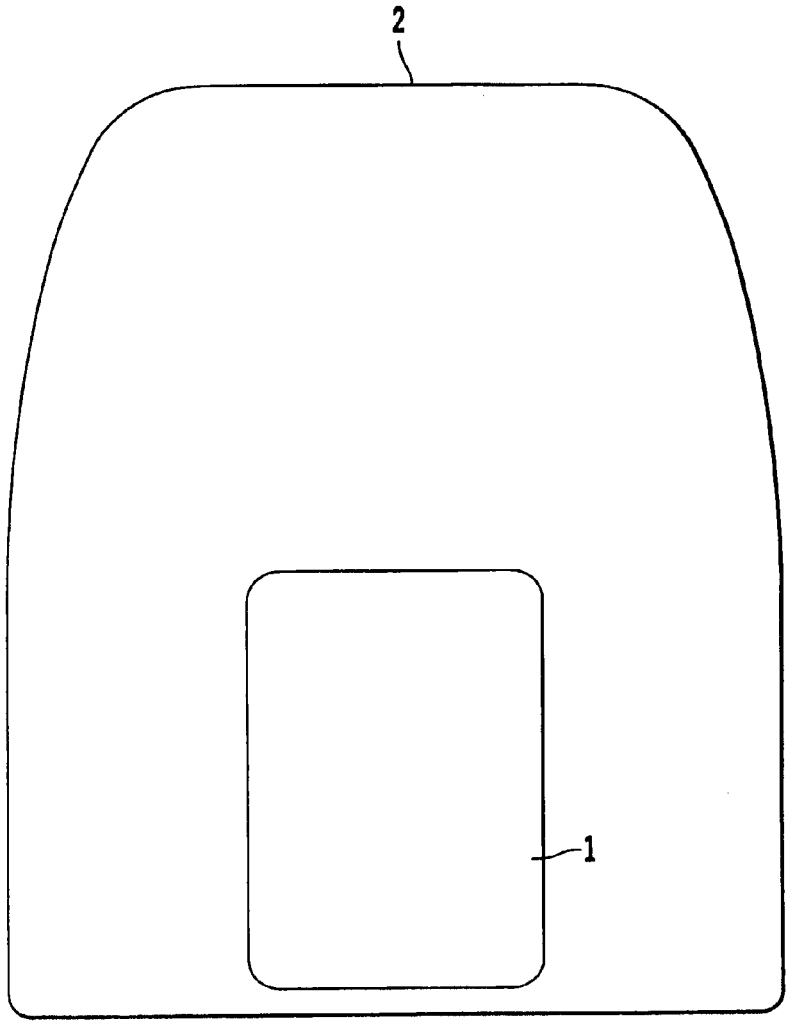

FIG. 3 shows an invention device with light source (1) and cover (2).

EMBODIMENT OF THE INVENTION

The invention relates to an illuminatable device, consisting essentially of a light source and a light-scattering cover which is associated with the light source and is made of coloured plastic.

The light source consists of one or more, or a plurality of, light-emitting diodes (LEDs) which emit coloured, essentially monochromatic light. Optionally, LEDs of different colour may also be used at the same time.

The colour of the LED depends in this case on the wavelength of its relative energy maximum. This relative energy maximum may, for example, be determined spectrophotometrically and recorded in a wavelength spectrum. It is possible, for example, to put the light source in an Ulbricht sphere (see DIN 5036) and analyse the emerging light. The highest point (peak) of the curve denotes the wavelength of the relative energy maximum in this case.

The number of LEDs depends on the size of the device, the luminosity of the LEDs which are used and the overall desired brightness of the device in the through-lit state. LEDs are, for example, available as modules each with 4 LEDs in a frame, a plurality of which may optionally be built into the device.

Light-Emitting Diodes (LEDs),

Suitable LEDs are, for example, red, blue, yellow or green LEDs.

A red LED has a relative energy maximum in the range of from about 610 to 640 nm.

The red LED (Osram LM03-B-A) has, for example, a relative energy maximum at about 620 nm.

A blue LED has a relative energy maximum in the range of from about 440 to 500 nm.

The blue LED (Osram LM03-B-B) has, for example, an energy maximum at about 460 nm.

The blue LED (ESS blue) has, for example, an energy maximum at about 475 nm.

A yellow LED has a relative energy maximum in the range of from about 570 to 610 nm.

The yellow LED (Osram LM03-B-Y) has, for example, an energy maximum at about 590 nm.

A green LED has a relative energy maximum in the range of from about 500 to 540 nm.

The green LED (Osram LM03-B-T) has, for example, an energy maximum at about 520 nm.

Light-Scattering Cover

The associated light-scattering cover made of plastic has a transmission (DIN 5036, see Parts 1 and 3) of at least 35%, preferably at least 38%, particularly preferably at least 41%, and a reflection (DIN 5036, Parts 1 and 3, reflection/re-emission) of at least 15%, preferably at least 20%, particularly preferably at least 30%, at the wavelength of the relative energy maximum of the light-emitting diode.

In particular, the transmission of a light-scattering cover associated with a yellow LED may be at least 50%, preferably at least 60%. The corresponding reflection may be at least 25%, preferably at least 30%.

In particular, the transmission of a light-scattering cover associated with a red LED may be at least 40%, preferably at least 45%. The corresponding reflection may be at least 22%, preferably at least 45%.

In particular, the transmission of a light-scattering cover associated with a green LED may be at least 40%, preferably at least 42%. The corresponding reflection may be at least 18%, preferably at least 20%.

In particular, the transmission of a light-scattering cover associated with a blue LED may be at least 40%, preferably at least 42%. The corresponding reflection may be at least 20%, preferably at least 22%.

In the event that LEDs of different colour are used at the same time in order to obtain mixed colours, for example yellow and green LEDs give a yellow-green colour impression, the associated light-scattering cover made of plastic should have the above-required transmission and reflection values at least at the wavelength of the relative energy maximum of one of the light-emitting diodes being used, for example the yellow or green LED.

The associated light-scattering cover consists of a plastic which is a plastic that is transparent in the uncoloured state and without scattering means, for example a transmissivity (DIN 5036, see Parts 1 and 3/D65) of at least 50%, preferably at least 70, particularly preferably from 75 to 92%. With scattering mean but without colorants, the transmissivity may favourably be at least 40%, particularly preferably at least 50%.

Suitable plastics are, for example, polymethyl methacrylate plastic, strength-modified polymethyl methacrylate, polycarbonate plastic, polystyrene plastic, styrene-acrylic-nitrile plastic, polyethylene terephthalate plastic, glycol-modified polyethylene terephthalate plastic, polyvinyl chloride plastic, transparent polyolefin plastic, acrylonitrile-butadiene-styrene (ABS) plastic or mixtures (blends) of various thermoplastics.

Owing to their high weathering resistance, polymethyl methacrylate plastics made of moulded or extruded polymethyl methacrylate, for example with a methyl methacrylate proportion of from 85 to 100%, are preferred, in particular for outdoor applications. Optionally, up to 15 wt. % of suitable comonomers, for example esters of methacrylic acid (for example ethyl methacrylate, butyl methacrylate, hexyl methacrylate, cyclohexyl methacrylate), esters of acrylic acid (for example methyl acrylate, ethyl acrylate, butyl acrylate, hexyl acrylate, cyclohexyl acrylate) or styrene and styrene derivatives, for example α-methylstyrene or p-methylstyrene may be co-polymerised or contained in the polymer.

The light-scattering power of the cover may, measured according to DIN 5036, preferably have a value of at least 0.5, particularly preferably at least 0.6, in particular at least 0.7. The better the light-scattering power is, the smaller are the distances from LEDs to the cover, and the concomitant structural depths of the device, which can be produced.

$BaSO_4$, polystyrene or light-scattering beads made of a crosslinked plastic may, for example, be used as light-scattering means.

$BaSO_4$ or polystyrene are preferred, and are preferably introduced into the plastic in an amount of from 1.5 to 2.5 wt. %.

Light-scattering beads made of a crosslinked plastic may preferably be introduced into the plastic in an amount of from 0.1 to 10 wt. %.

The requirement for high transmission with high light scattering is a requirement which is difficult to fulfil. A high scattering power is achieved by titanium dioxide. However, since this colorant reflects a large part of the light, only small light transmissivities are possible. Colourless scattering pigments whose refractive index differs by up to about 0.2 from the reflective index of the acrylic glass are more favourable. Suitable examples include calcium carbonate, magnesium carbonate, aluminium trihydroxide, magnesium hydroxide, barium sulphate etc.

It is likewise possible to use polymers which lie in the suitable refractive-index range. Polystyrene, which subsequently precipitates during the polymerisation and leads to a material with good light scattering, may for example be dissolved in the monomer methyl methacrylate. It is also possible, however, to add polymer particles, for example polymer beads made of crosslinked polystyrene or crosslinked copolymers of methyl methacrylate with phenyl (meth)acrylate or benzyl (meth)acrylate.

Production of the Coloured Light-Scattering Cover Made of Plastic

Scattering means and colorants may be added to or incorporated in the plastic, during production by polymerisation in the polymerisable mixture or during thermoplastic processing in the molten state, for example by means of extrusion or injection moulding, in a manner which is known per se. Besides the plate shape, it is also possible to manufacture arbitrary profiles, such as tubes, rods, etc.

In this way, it is possible to obtain for example plastic plates, for example with a thickness of for example from 0.5 to 10, preferably from 1 to 5 mm, which can be used as covers for illuminatable devices according to the invention with rectangular boxes, frames or support. Corresponding pieces can also be converted and adapted into almost arbitrary shapes, according to requirements, by cutting, milling, sawing or other processing.

Device

The device may be configured in such a way that the LEDs and the light-scattering cover are associated with one another at a distance of from 3 to 12 cm, preferably from 4 to 10 cm. Good lighting is obtained at this distance. If the distance is too small, the position of the LED becomes visible in the form of a bright spot. If the distance is too large, the brightness is reduced too much.

The LEDs may, for example, be located in a box or frame which is covered by the light-scattering cover. The cover may be provided with a layer carrying information, for example a film, or may itself already be in the form of information, for example in the shape of a letter or number.

Colorants

Preferably organic colorants are suitable as colorants for the purpose of the invention, since they have high brilliance and luminosity both under incident light and in transmitted light. In order to protect the acrylic glass against the effects of light and weather, light-protection agents, UV absorbers, antioxidants etc. may also be added.

Appropriate colorants include colorants which are soluble, in particular, in plastic, or organic pigments, but also less preferably insoluble inorganic colour pigments. Examples which may be mentioned include:

For yellow colorations: pyrazolone yellow and perinone orange, or mixtures thereof.

For red colorations: naphthol AS and DPP red, or mixtures thereof.

For green colorations: mixtures of Cu phthalocyanine green and pyrazolone yellow.

For blue colorations: anthraquinone blue and ultramarine blue, or mixtures thereof.

Colour Loci

The invention is based on the consideration that the closer the colour loci of the transmission and the re-emission of the coloured cover lie to the colour locus of the LED, the better should be the match of the colour impression under incident light and under transmitted lighting. It has been shown, however, that a match of a coloration with a given LED colour locus can be achieved only approximately in practice. In general, deviations that lie on or near to a straight line which passes through the achromatic point (x/y=0.33/0.33) and the colour locus of the LED can be tolerated rather more than deviations which, although equal in size, nevertheless lie further off from the described straight line.

It is expedient for the colour loci to be situated as much as possible at the edge of the colour standard chart, since the colour brilliance is the highest here. This is due to the fact that the colour loci of the LEDs, owing to the monochromatic light, likewise lie at the edge or close to the edge of the standard colour chart. It should be noted, however, that the actually establishable (measured) colour loci may actually differ from the colour loci to be expected theoretically.

In many cases, corresponding colorations cannot be achieved with just one colorant. For mixtures, care should be taken that the individual components do not lie too far away from one another on the colour standard chart, since the mixed colour shade may then have too low a brilliance.

Figure 2:
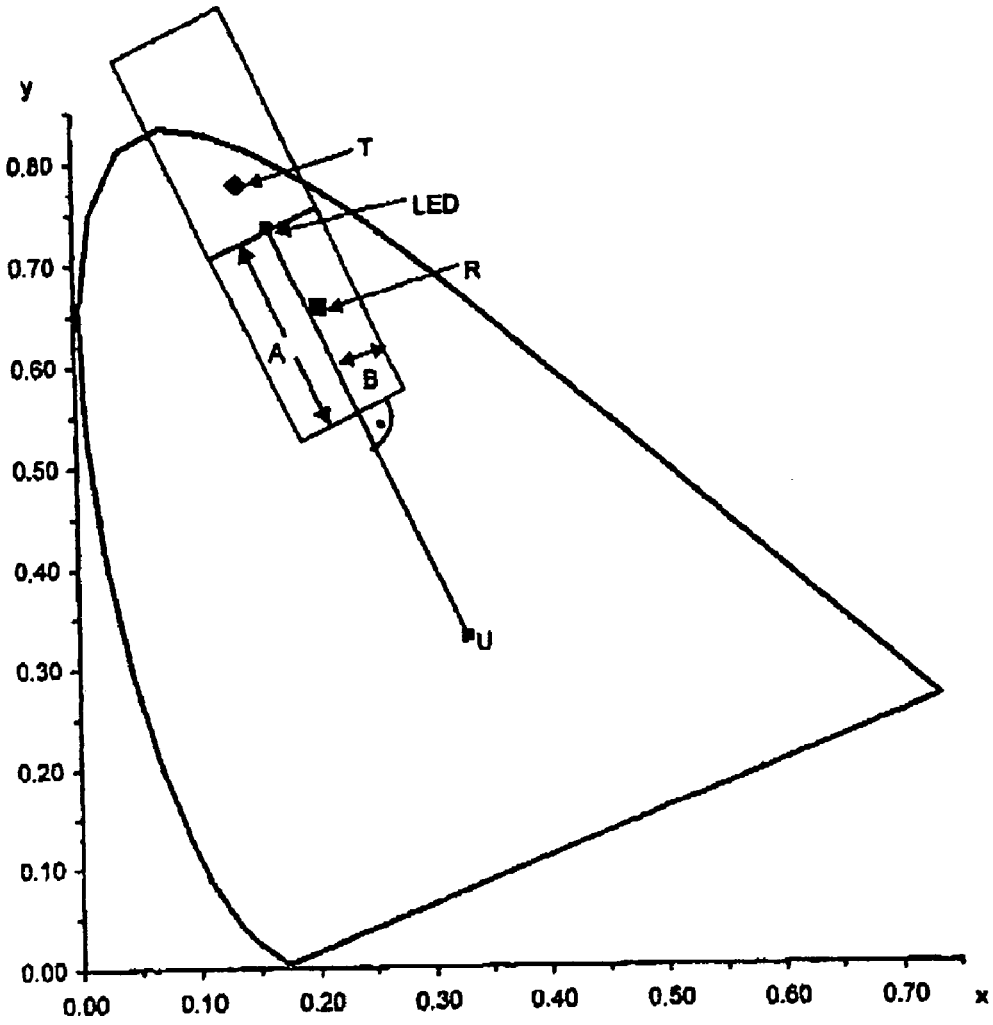

The colour loci of the transmission and the re-emission of the coloured cover made of plastic, with respect to the standard colour chart, should preferably lie in a region which, with respect to a straight line which passes through the achromatic point (x/y=0.33/0.33) and the colour locus of the LED, lies no more than 0.2 x/y units, preferably no more than 0.1 x/y units, away from the colour locus of the LED in the direction of the straight line and no more than 0.05 x/y units, preferably no more than 0.03 x/y, away at right angles on both sides of the straight line (cf. FIG. 2/2).

For the measurement of colour loci, commercial measuring instruments are available to the person skilled in the art.

Device for Yellow (or Yellow-Green) Lighting

The LEDs which are used may, for example, emit yellow (or yellow-green) light and have a colour locus in the region of the coordinates x/y=0.5/0.5+/−0.02.

The plastic of the cover may in this case be coloured with a mixture of from 0.075 to 0.09, preferably from 0.081 to 0.084 wt. % of pyrazolone yellow and from 0.002 to 0.004, preferably from 0.0028 to 0.0032 wt. % of perinone orange.

It is favourable to combine this coloration with $BaSO_4$ as a scattering agent in an amount of from 1.9 to 2.1 wt. %.

Device for Red Lighting

The LEDs which are used may, for example, emit red light and have a colour locus in the region of the coordinates x/y=0.67/0.33+/−0.02.

The plastic of the cover may in this case be coloured with a mixture of from 0.13 to 0.17, preferably from 0.14 to 0.16 wt. % of pyrazolone yellow and from 0.01 to 0.03, preferably from 0.017 to 0.23 wt. % of anthraquinone red.

It is favourable to combine this coloration with polystyrene as a scattering agent in an amount of from 1.9 to 2.1 wt. %.

The plastic of the cover may in this case be coloured with a mixture of from 0.055 to 0.07, preferably from 0.061 to 0.064 wt. % of naphthol AS (2-hydroxy-3-naphthoic acid anilide) and from 0.005 to 0.015, preferably from 0.008 to 0.012 wt. % of DPP red (dipyrrolopyrrol red).

It is favourable to combine this coloration with $BaSO_4$ as a scattering agent in an amount of from 1.9 to 2.1 wt. %.

Device for Green Lighting

The LEDs which are used may, for example, emit green light and have a colour locus in the region of the coordinates x/y=0.16/0.73+/−0.02.

The plastic of the cover may in this case be coloured with a mixture of from 0.01 to 0.025, preferably from 0.013 to 0.017 wt. % of Cu phthalocyanine green and from 0.025 to 0.045, preferably from 0.028 to 0.032 wt. % of pyrazolone yellow.

It is favourable to combine this coloration with $BaSO_4$ or polystyrene as a scattering agent in an amount of from 1.9 to 2.1 wt. %.

Device for Blue Lighting

The LEDs which are used may, for example, emit blue light and have a colour locus in the region of the coordinates x/y=0.14/0.06+/−0.02.

The plastic of the cover may in this case be coloured with a mixture of from 0.005 to 0.01, preferably from 0.006 to 0.008 wt. % of anthraquinone blue and from 0.05 to 0.1, preferably from 0.07 to 0.08 wt. % of ultramarine blue.

It is favourable to combine this coloration with $BaSO_4$ as a scattering agent in an amount of from 1.9 to 2.1 wt. %.

The plastic of the cover may also be coloured with from 0.007 to 0.013, preferably from 0.009 to 0.011 wt. % of anthraquinone blue.

It is favourable to combine this coloration with polystyrene as a scattering agent in an amount of from 1.9 to 2.1 wt. %.

Uses

In the device according to the invention, the described coloured plastic elements containing scattering agents are used as the cover, and colour LEDs are used as the light source.

EXAMPLES

Examples Series 1: Red 1, Yellow 1, Blue 1, Green 1

0.5 part of t-butyl perpivalate and
20 parts of polystyrene (for example from BASF)
are dissolved in 1000 parts of methyl methacrylate.

The dyes according to Tab. 1 are added thereto, dissolved by intense stirring, introduced into a silicate glass chamber spaced by 3 mm thick string and polymerised for about 16 hours in a water bath at 45° C. The final polymerisation takes place for about 4 hours in an oven at 115° C.

Examples Series 2: Red 2, Yellow 2, Blue 2, Green 2

1 part of 2,2'-azobis(2,4-dimethyl valeronitrile)
is dissolved in 1000 parts of prepolymer methyl methacrylate syrup. (viscosity approximately 1000 cP).
A colour paste consisting of
3 parts of a soluble polymethyl methacrylate resin,
20 parts of barium sulphate
and the colorants according to Tab. 2, which are dispersed in
30 parts of methyl methacrylate using a high-speed disperser (rotor/stator principle),
is added to this batch.

The batch is stirred intensely, introduced into a silicate glass chamber spaced by 3 mm thick string and polymerised for about 16 hours in a water bath at 45° C. The final polymerisation takes place for about 4 hours in an oven at 115° C.

Results

In a white-painted sheet-metal box open at the top, with dimensions 90×470 mm and 100 mm in height, 32 light-emitting diodes, for example from OSRAM (8 modules a'4 LEDs) are respectively fitted on the inner bottom (There are standard LEDs from many manufacturers which have a comparable colour shade to one another). Using a power supply unit, the acceptable operating current of between 320–400 mA, depending on the type, is set with an operating voltage of 10 V.

The patterns described above are placed on this box and assessed for colour. The incident-light test (day effect) is carried out by illumination with a daylight lamp rated at 150 W D65 according to DIN 6173, quality class 1, for example from Siemens) from above at a distance of about 60 cm. The LEDs are in this case switched off. The transmitted-light test is carried out in a darkened room, with the LEDs switched on, according to the above operating data. The colour measurements are taken using a Chroma-Meter CS-100 calorimeter from Minolta. This instrument allows contactless measurements of light sources and object colours. The sample/instrument distance is 1 m. The luminance Y in $cd/m^2$ is then also measured using this instrument.

The results of the colour measurements and luminances are presented in Table 3. For comparison, Table 4 shows corresponding colour measurements and luminances of commercially available covers made of polymethyl methacrylate with standard colorations, which are not specially matched to the LEDs.

TABLE 1

| | Dye series 1 | | | | | |
|---|---|---|---|---|---|---|
| Colour | Cu phthalocyanine green | Pyrazolone yellow | Anthraquinone blue | Perinone orange | Anthraquinone violet | Anthraquinone red |
| Red 1 | — | 0.1500 | — | — | — | 0.0200 |
| Yellow 1 | — | 0.0825 | — | 0.003 | — | — |
| Green 1 | 0.0200 | 0.0400 | — | — | — | — |
| Blue 1 | — | — | 0.0100 | — | — | — |

Data: in wt. %

TABLE 2

| | Colorant series 2 | | | | | | |
|---|---|---|---|---|---|---|---|
| Colour | Naphthol AS | DPP red | Cu phthalocyanine green | Ultramarine blue | Pyrazolone yellow | Anthraquinone blue | Perinone orange |
| Red 2 | 0.0625 | 0.01 | — | — | — | — | — |
| Yellow 2 | — | — | — | — | 0.0825 | — | 0.003 |
| Green 2 | — | — | 0.015 | — | 0.03 | — | — |
| Blue 2 | — | — | — | 0.077 | — | 0.007 | — |

Data: in wt. %

TABLE 3

Colour coordinates x, y and luminance Y in Cd/m$^2$ for LED backlighting with colorations according to the invention.

| Colour | LEDλmax in nm | Transmission at LEDλmax | Reflection at LEDλmax | Y in cd/m2 | x | y |
|---|---|---|---|---|---|---|
| Yellow 1 | 590 | 62% | 26% | 141 | 0.527 | 0.467 |
| Yellow 2 | 590 | 55% | 32% | 130 | 0.533 | 0.461 |
| Red 1 | 620 | 48% | 23% | 127 | 0.682 | 0.317 |
| Red 2 | 620 | 42% | 50% | 120 | 0.682 | 0.317 |
| Green 1 | 520 | 43% | 19% | 36.3 | 0.141 | 0.780 |
| Green 2 | 520 | 41% | 21% | 36.4 | 0.139 | 0.777 |
| Blue 1 | 460 | 43% | 24% | 6.56 | 0.138 | 0.045 |
| Blue 2 | 460 | 43% | 24% | 6.31 | 0.138 | 0.041 |

TABLE 4

Comparative measurements with commercially available plastic covers

| Colour | LEDλmax in nm | Transmission at LEDλmax | Reflection at LEDλmax | Y in Cd/m2 | x | y |
|---|---|---|---|---|---|---|
| Yellow 370* | 590 | 28% | 62% | 55.1 | 0.582 | 0.417 |
| Red 568* | 620 | 20% | 50% | 49.7 | 0.686 | 0.313 |
| Green 710* | 520 | 18% | 18% | 11.4 | 0.139 | 0.779 |
| Blue 601* | 460 | 30% | 27% | 4.31 | 0.139 | 0.037 |

*= Product definitions from the manufacturer, Röhm & Co. KG, D-64293 Darmstadt

The results (Tab. 3) show that, with the colour acrylic glasses produced according to the above procedure, significantly higher luminances (brightnesses) are achieved in LED backlighting compared with the colorations which correspond to the prior art (Tab. 4). At the same time, the light scattering is so good that uniform lighting is achieved at a distance of only 40 mm from the LED.

TABLE 5

Measurements on comparative samples according to the examples of Series 1 and 2, although without colorants but with the indicated scattering means in the indicated amounts (polystyrene or barium sulphate), show a scattering power >0.5 with a transmissivity >40%.

| Additive | Scattering power | Transmissivity |
|---|---|---|
| Polystyrene | 0.65 | 56% |
| Barium sulphate | 0.80 | 50.5% |

For comparison: Using a corresponding white coloration with titanium dioxide, a very good scattering power of about 0.90 can be achieved. The transmissivity, however, is then merely around 20–30%. These versions therefore appear very dark in transmitted light and are therefore generally unsuitable for the purpose of the invention.

If the colour coordinates according to Tab. 3 are plotted in the standard colour chart (see, for example, DIN 5033 or corresponding standard literature), it is clear that the values (and therefore the colour shades) lie, to within the limits required by the invention, close to the line of the wavelength of equal colour shade (line between the achromatic point and the colour locus of the respective LED colour). The good match between the colour shade under incident and transmitted light can be seen during the visual test.

Using the transmission curve according to FIG. 1/2 for green LEDs, it can be seen that the maxima of the transmission and the reflection of the coloration green 1 (series 1) coincide very well with the wavelength of the relative energy maximum of the LED. In these ranges, the transmission values lie significantly above the required 30%, and the reflection values lie above the required 15%.

The invention claimed is:

1. An illuminatable device, comprising:

a light source; and a light-scattering cover associated with the light source made of colored plastic, wherein the light source includes one or more light-emitting diode (LED) that emit colored, essentially monochromatic light, and the associated light-scattering cover has a transmission, measured according to DIN 5036, of at least 35% and a reflection, measured according to DIN 5036, of at least 15% at a wavelength of maximum relative energy of the light-emitting diode.

2. A device according to claim 1, wherein the one or more LED and the light-scattering cover are associated with one another at a distance of from 3 to 12 cm.

3. A device according to claim 1, wherein the light-scattering cover includes a moulded or extruded polymethyl methacrylate plastic.

4. A device according to claim 1, wherein the plastic of the light-scattering cover has a light-scattering power, measured according to DIN 5036, of at least 0.5.

5. A device according to claim 4, wherein $BaSO_4$, polystyrene, or light-scattering beads made of a crosslinked plastic are contained in the light-scattering cover.

6. A device according to claim 5, wherein $BaSO_4$ or polystyrene are contained in an amount of from 1.5 to 2.5 wt. %.

7. A device according to claim 1, wherein the one or more LED is located in a box or frame covered by the light-scattering cover.

8. A device according to claim 1, wherein color loci of transmission and re-emission of the colored cover made of plastic, with respect to a standard color chart, lie in a region which, with respect to a straight line that passes through achromatic point (x/y=0.33/0.33) and color locus of the one or more LED, lies no more than 0.2 x/y units away from color locus of the one or more LED in the direction of the straight line and no more than 0.05 x/y units away at right angles on both sides of the straight line.

9. A device according to claim 1, wherein the one or more LED emits yellow light and has a color locus in a region of coordinates x/y=0.5/0.5 +/−0.02.

10. A device according to claim 9, wherein the plastic of the light-scattering cover is colored with from 0.075 to 0.09 wt. % of pyrazolone yellow and from 0.002 to 0.004 wt. % of perinone orange.

11. A device according to claim 1, wherein the one or more LED emits red light and has a color locus in a region of coordinates x/y=0.67/0.33 +/−0.02.

12. A device according to claim 11, wherein the plastic of the light-scattering cover is colored with from 0.13 to 0.17 wt. % of pyrazolone yellow and from 0.01 to 0.03 wt. % of anthraquinone red.

13. A device according to claim 11, wherein the plastic of the light-scattering cover is colored with from 0.055 to 0.07 wt. % of naphthol AS and from 0.005 to 0.015 wt. % of DPP red.

14. A device according to claim 1, wherein the one or more LED emits green light and has a color locus in a region of coordinates x/y=0.16/0.73 +/−0.02.

15. Device according to claim 14, wherein the plastic of the light-scattering cover is colored with from 0.01 to 0.025 wt. % of Cu phthalocyanine green and from 0.025 to 0.045 wt. % of pyrazolone yellow.

16. Device according to claim 1, wherein the one or more LED emits blue light and has a color locus in a region of coordinates x/y=0.14/0.06 +/−0.02.

17. Device according to claim 16, wherein the plastic of the light-scattering cover is colored with from 0.05 to 0.1 wt. % of ultramarine blue and from 0.005 to 0.01 wt. % of anthraquinone blue.

18. Device according to claim 16, wherein the plastic of the light-scattering cover is colored with from 0.007 to 0.013 wt. % of anthraquinone blue.

* * * * *